US009217598B2

(12) United States Patent
Passley

(10) Patent No.: US 9,217,598 B2
(45) Date of Patent: Dec. 22, 2015

(54) FOLDABLE REFRIGERATOR

(71) Applicant: Shaun Passley, Chicago, IL (US)

(72) Inventor: Shaun Passley, Chicago, IL (US)

(73) Assignee: EPAZZ, INC., Chicago, IL (US)

( * ) Notice: Subject to any disclaimer, the term of this patent is extended or adjusted under 35 U.S.C. 154(b) by 150 days.

(21) Appl. No.: 14/190,683

(22) Filed: Feb. 26, 2014

(65) Prior Publication Data

US 2015/0241109 A1 Aug. 27, 2015

(51) Int. Cl.
*F25D 11/00* (2006.01)
*F25D 17/06* (2006.01)

(52) U.S. Cl.
CPC ..... *F25D 11/003* (2013.01); *F25D 17/06* (2013.01)

(58) Field of Classification Search
CPC ..... F25D 11/003; F25D 17/06; F25D 11/00; F25D 11/006; F25D 11/02
USPC ..... 62/426, 326, 435, 440, 298, 457.7; 220/592.03, 592.2; 312/258, 406
See application file for complete search history.

(56) References Cited

U.S. PATENT DOCUMENTS 2,605,617 A * 8/1952 Replogle ..... F25D 23/062 16/319
5,480,170 A * 1/1996 Kaiser, II ..... A47B 31/02 108/80
5,781,853 A * 7/1998 Johnson ..... H04B 1/08 381/386
5,860,281 A * 1/1999 Coffee ..... A45C 11/20 312/298
6,426,699 B1 * 7/2002 Porter ..... A47F 10/00 221/2
7,306,243 B2 * 12/2007 Van Horn ..... A45C 7/0022 280/30
7,596,960 B2 * 10/2009 Bae ..... F24F 1/0007 62/263
2003/0230095 A1 * 12/2003 Kahler ..... A47F 3/0486 62/155
2005/0279750 A1 * 12/2005 Barquist ..... F16M 11/32 220/629
2007/0256440 A1 * 11/2007 Trotter ..... F25D 11/00 62/298
2013/0200083 A1 * 8/2013 Cunningham ..... B65D 81/3893 220/592.2
2013/0233002 A1 * 9/2013 Donaldson ..... F24F 5/0021 62/99

* cited by examiner

*Primary Examiner* — Mohammad M Ali
(74) *Attorney, Agent, or Firm* — Justin Lampel

(57) ABSTRACT

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

14 Claims, 16 Drawing Sheets

FOLDABLE REFRIGERATOR

CROSS REFERENCE TO RELATED APPLICATION

The following application is based on and claims the priority benefit of U.S. Provisional Application Ser. No. 61/769,261 filed on Feb. 26, 2013; the entire contents of which are incorporated by reference.

BACKGROUND OF THE INVENTION

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

Attempts have been made to provide foldable cooling devices. For example, U.S. Pat. No. 5,403,095 to Melk discloses a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

Still further, U.S. Pat. No. 5,472,279 to Lin discloses a thermally insulating carrier for preventing temperature change of heated or cooled items placed therein. The carrier includes a flexible bag-like container having a compartment therein and a generally rigid hollow tub-like liner member which is removably disposed in the compartment. The flexible container includes a side wall portion, a base portion, and a displaceable cover. At least the side wall portion and cover are constructed incorporating a flexible insulating material for providing an insulating effect. The side wall portion is joined with the base portion and together with the cover define the compartment. A container aperture is defined by a top edge of the side wall portion. A closing device is attached to the container aperture and a perimeter of the cover for releasably retaining the cover over the container aperture. The hollow liner is integrally formed of a rigid, waterproof, and shatterproof material with side portions joined to a bottom portion. A mouth is formed around the top of the liner and is coincident with the container aperture. The liner improves the thermal characteristics, provides structural support for the flexible container, and prevents leakage of moisture from the flexible container.

However, these cooling devices fail to disclose a foldable refrigerator which is easy to use and efficient. A need, therefore, exists for an improved foldable refrigerator and method of using the same.

SUMMARY OF THE INVENTION

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

An advantage of the present device is to provide a foldable refrigerator which is easy to transport.

Yet another advantage of the present device is to provide a foldable refrigerator which is easy to store.

And advantage of the present device is to provide a foldable refrigerator which is environmentally friendly.

Yet another advantage of the present foldable refrigerator is that the device may have an interior having multiple temperature zones.

Yet another advantage of the foldable refrigerator is that the device may have adjustable legs which allow the device to be elevated at various levels.

Still another advantage of the present foldable refrigerator is that the device may have an extendable handle and wheels for pulling or pushing the device in a similar manner as luggage.

And another advantage of the foldable refrigerator is that the device has a solid, sturdy protective exterior surface which protects the interior of the device and its contents while still being lightweight.

Still another advantage of the present foldable refrigerator is that the refrigerator may have a gyroscope which allows the compressor of the refrigerator to always remain upright.

Yet another advantage of the foldable refrigerator is that the device may have a window on the door which allows a user to save energy by determining what the user wants from inside the refrigerator prior to opening the door.

For a more complete understanding of the above listed features and advantages of the present foldable refrigerator, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A foldable refrigerator is provided. The foldable refrigerator moves from a functional First Position A to a collapsed Second Position B. The foldable refrigerator may be folded into the collapsed Second Position B for transportation and/or storage. The foldable refrigerator has an extendable handle and wheels which allow pulling or pushing the refrigerator in a manner similar to luggage. The refrigerator further has extendable and adjustable legs which allow the refrigerator to be raised or lowered to various heights. The refrigerator has a gyroscope which allows the compressor of the refrigerator to remain in an upright position.

Figure 1:
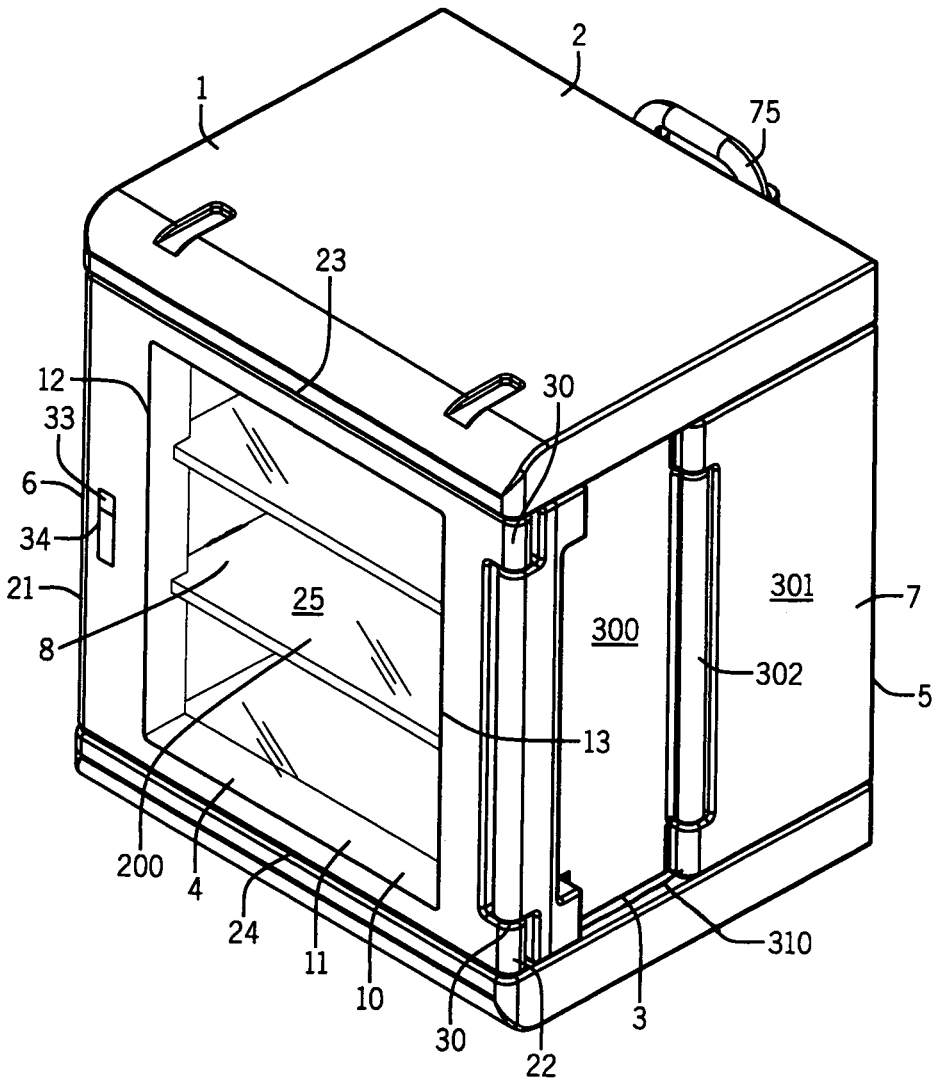
FIG. 1 illustrates a front perspective view of the First Embodiment of the foldable refrigerator in the functional First Position A.

Referring now to FIG. 1, a foldable refrigerator 1 is provided. The foldable refrigerator 1 may have a top 2, a bottom 3, a front 4, a back 5, a first side 6, a second side 7 and a generally hollow interior 8. The top 2, bottom 3, front 4, back 5, first side 6 and second side 7 of the device 1 may be constructed with insulated walls so as to reduce heat exchange between the outside of the refrigerator 1 and the interior 8 of the refrigerator 1. In an embodiment, the interior 8 may be approximately four cubic feet (although embodiments may vary dramatically).

The foldable refrigerator 1 may be largely made from an insulating material such as, for example, foam rubbers (polyurethanes), aerogels (silicon dioxides), neoprene or carbon black. The insulating material may be highly foldable so as to allow the foldable refrigerator 1 to move from a collapsed Second Position B (the stored position of FIG. 2) to a functional First Position A (the usable position of FIG. 1). In the functional First Position A (FIG. 1) the foldable refrigerator 1 may be in a largely cubic configuration when compared to the collapsed Second Position B wherein the foldable refrigerator 1 is in a generally in a flat configuration.

The front 4 of the foldable refrigerator 1 may have a door 10. In an embodiment, the door 10 may have a large window 11 so as to allow a user to see inside the interior 8 of the refrigerator 1 without the need to open the door 10. The window 11 may have a first side 12, a second side 13 and a back. The door 10 may have a first side 21, a second side 22, a top 23, a bottom 24 and a front 25. In an embodiment, the second side 22 of the door 10 may be permanently secured to a portion of the second side 7 of the device 1. More specifically, the second side 22 of the door 10 may be connected to the second side 7 of the refrigerator 1 at a hinge 30. The hinge 30 may allow the door 10 to move from a closed position (FIG. 1) to an open position (not shown) or vice versa; wherein the user can access the interior 8 of the refrigerator 1 when the door 10 is in the open position. A lock 33 on the door 10 may be temporarily secured to a corresponding latch 34 on the front 25 of the door 10 and may prevent the door 10 for inadvertently opening.

In an embodiment, the window portion 11 may be made or, for example, glass or plastic, and may cover a large percentage of the front 25 of the door 10 so as to maximize the viewing area for the user. Preferably, the window portion 11 is thick so as to reduce the chance of breakage and so as to increase the R-factor to reduce heat exchange with the outside; therein conserving energy.

Figure 3:
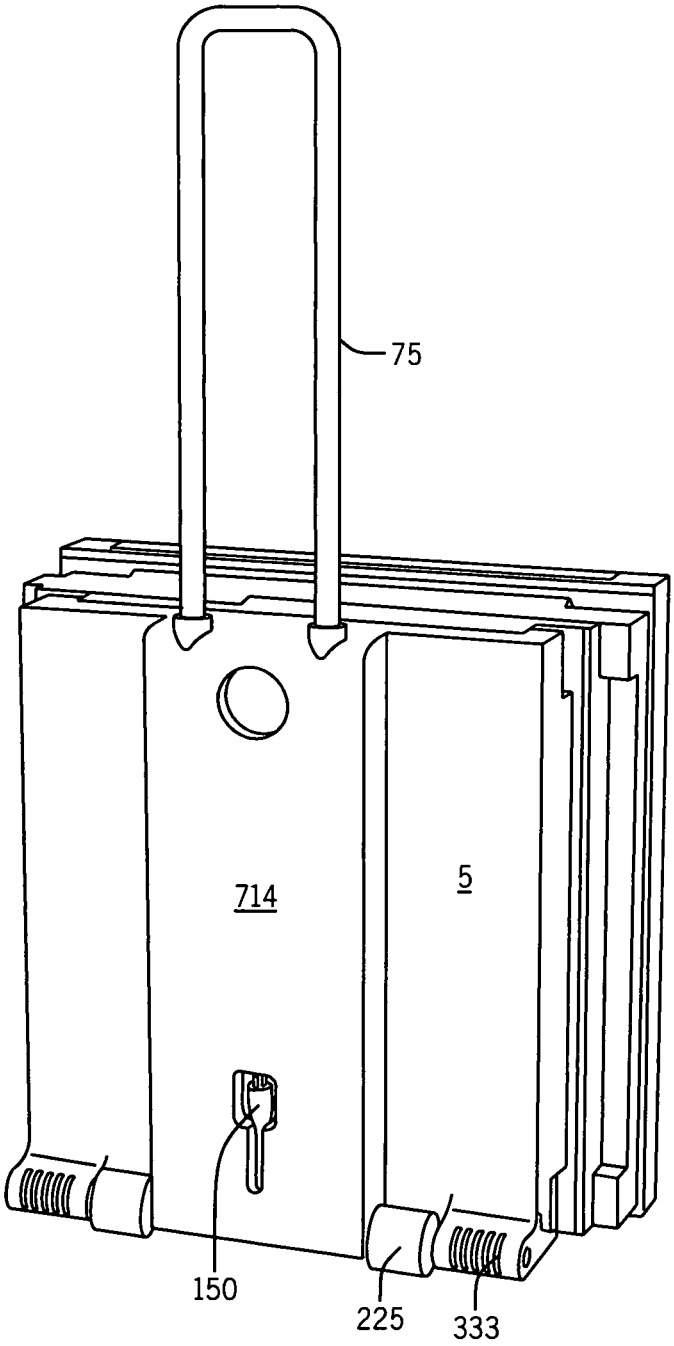
FIG. 3 illustrates a back perspective view of the First Embodiment of the foldable refrigerator in the collapsed Second Position B.

Referring now to FIG. 3, in an embodiment, the back 5 of the device 1 may have a wheel support assembly 333. The wheel support assembly 333 may be located at the bottom 3 of the device 1 and may allow the wheels 225 of the refrigerator 1 to be securely attached to the device 1. In an embodiment, the wheel support assembly 333 may have a plurality of vertical groves which creates additional friction with the ground and allows the wheel support assembly 333 to act as a brake when a user is pulling the refrigerator 1 by the handle 75.

Figure 13:
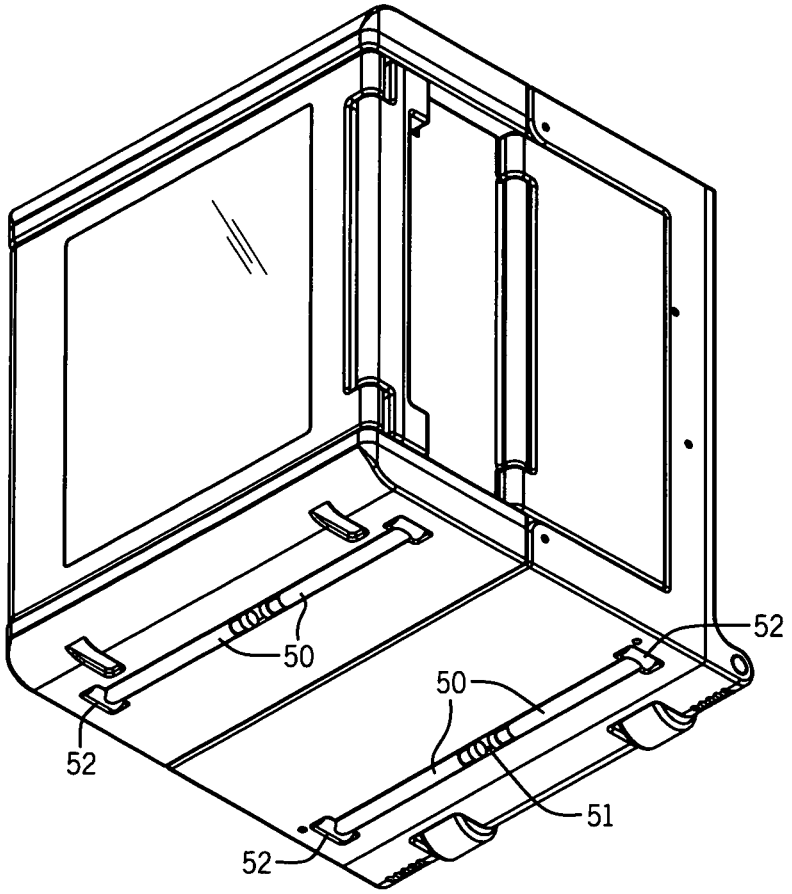
FIG. 13 illustrates a bottom perspective view of the Second Embodiment of the foldable refrigerator in the functional First Position A.
Figure 14:
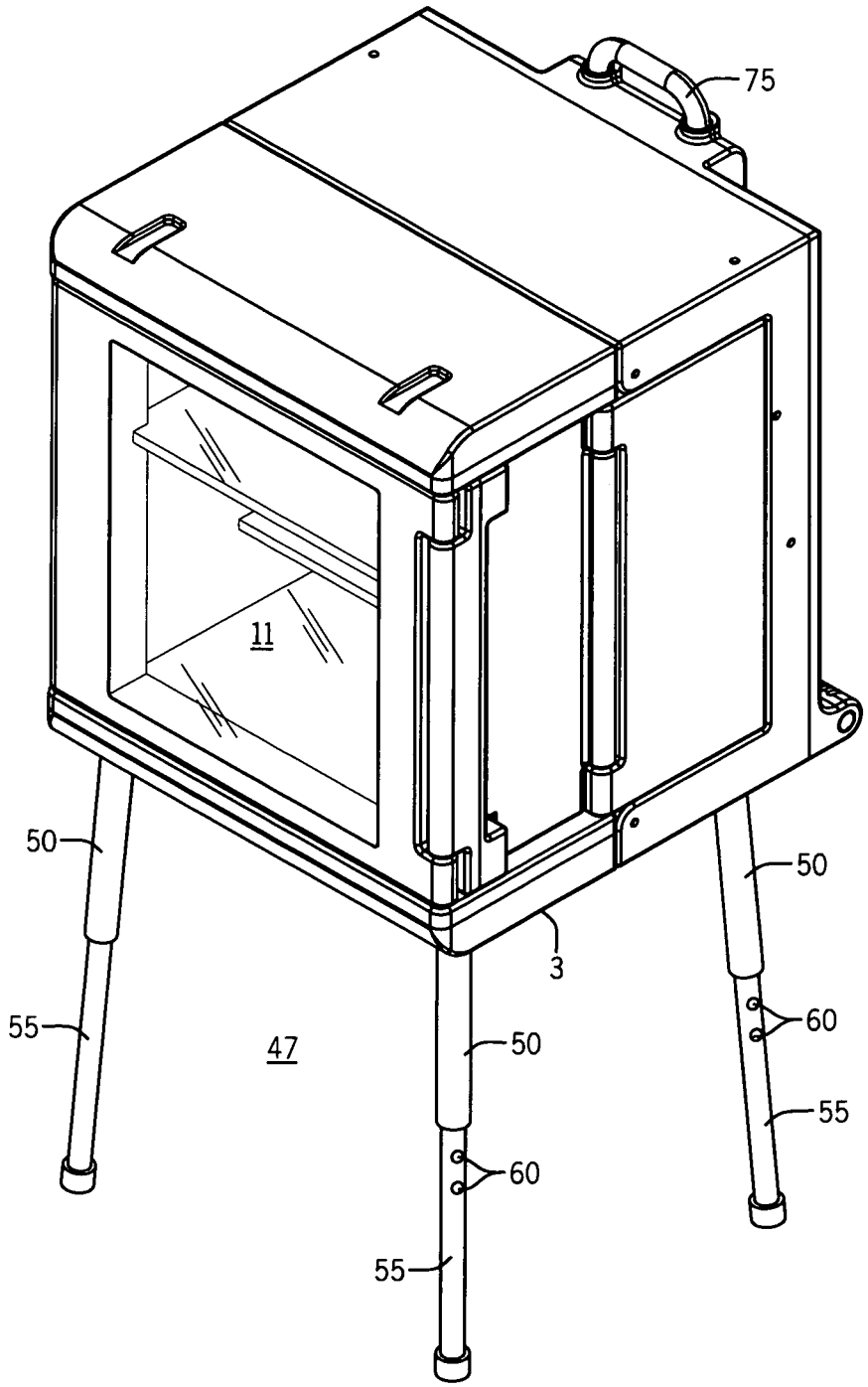
FIG. 14 illustrates a front perspective view of the Second Embodiment of the foldable refrigerator in the functional First Position A wherein the legs are extended.

Referring now to FIG. 14, located on the bottom 3 of the refrigerator 1 may be a plurality of telescopingly extendable legs 50. Preferably, the refrigerator 1 has four telescopingly extendable legs 50; however, the device 1 may have a greater or fewer number of telescopingly extendable legs 50 so long as the device 1 remains stable when the legs 50 are extended and the device 1 is resting on the legs 50. The telescopingly extendable legs 50 may move from a usable First Position A (FIG. 14) to a collapsed Second Position B (FIG. 13). In the collapsed Second Position B, the telescopingly extendable legs 50 are substantially shortened and are located within a generally rectangular opening slot 51 located on the bottom 3 of the refrigerator 1. In this collapsed Second Position B, the extendable legs 50 are protected from damage which is more likely to occur when the extendable legs 50 are extended in the functional first Position A. In addition, in the collapsed Second Position B, the legs 50 are retracted and the device 1 is easier and more foldable to transport.

In the collapsed Second Position B, the extendable legs 50 are generally in a flush orientation with the bottom 3 of the refrigerator 1 such that the refrigerator 1 may be placed on the ground and the extendable legs 50 will not contact the ground. A hinge 52 located at the ends of the rectangular opening slots 51 and secured to each of the extendable legs 50 may allow the extendable legs 50 to move from a generally parallel orientation with respect to the bottom 3 of the refrigerator 1 to a generally perpendicular orientation with respect to the bottom 3 of the refrigerator 1 (FIG. 14). Once the extendable legs 50 are moved to the generally perpendicular orientation with respect to the bottom 3, the extendable legs 50 may further extend downward as a result of a slightly thinner leg portion 55 which is telescopically stored within the main body of the legs 50.

In the functional First Position A, the telescopingly extendable legs 50 are extended away from the bottom 3 of the device 1. As a result, the bottom 3 of the refrigerator 1 may be elevated to allow for easier access for the user. In addition, when the telescopingly extendable legs 50 are extended, a storage area 47 is created under the bottom 3 of the device 1 for storing items. In an embodiment, the telescopingly extendable legs 50 may have notches 60 which interact with grooves (not shown) located within the upper portion of the extendable legs 50. The notches 60 of the extendable legs 50 may allow the extendable legs 50 to be raised or lowered to various heights.

The refrigerator 1 may further have an extendable handle 75 which move from a functional First Position A (FIG. 7) to a collapsed Second Position B (FIG. 14). In an embodiment, the extendable handle 75 may extend from within hollow tubes (not shown) located within an interior portion of the back 5 of the refrigerator 1. The extendable handle 75 may extend upward, away from the main body of the device 1 and may allow the device 1 to be easily carried or transported. The extendable handle 75 may operate and work similar to an extendable handle 75 often associated with luggage.

Figure 12A:
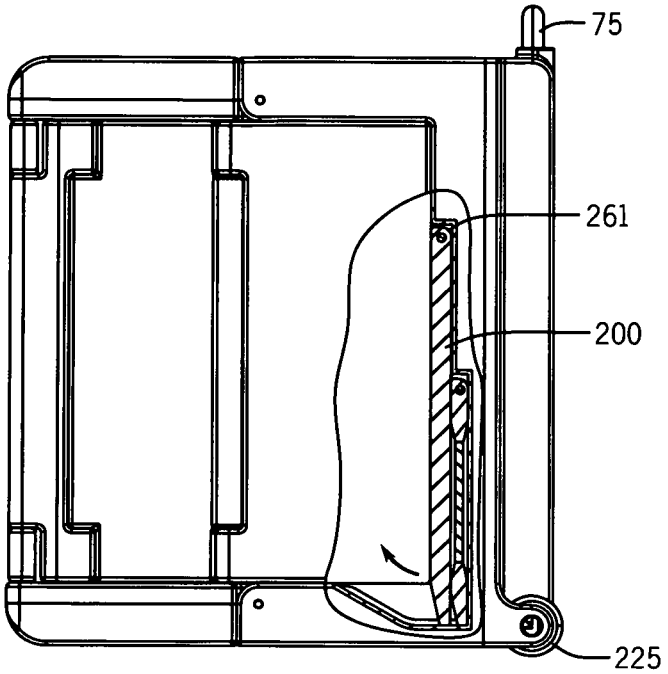
FIG. 12*a* illustrates a side view of the foldable refrigerator wherein a portion of the refrigerator is cut away.
Figure 12B:
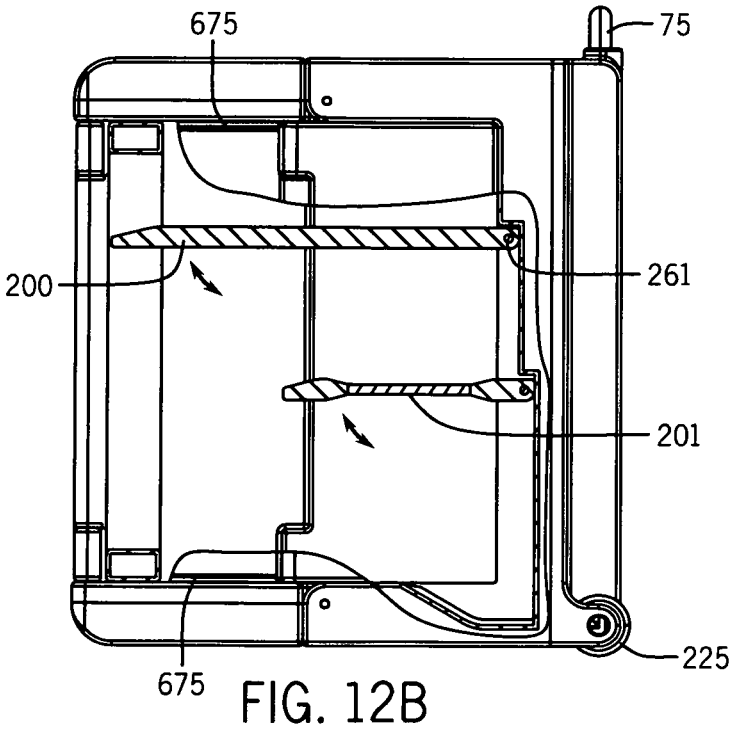
FIG. 12*b* illustrates a side view of the foldable refrigerator wherein a portion of the refrigerator is cut away.

Referring now to FIGS. 12*a* and 12*b*, in an embodiment, the device 1 may have a plurality of wheels 225 (generally 2 or 4 wheels). The wheels 225 may allow the device 1 to be pulled or pushed. Further, when the extendable handle 75 is extended from the main body of the device 1, the device 1 may be pushed or pulled on the wheels 225 in a manner similar to that of luggage. Preferably, the wheels 225 are located on the back 5 of the device 1 and at the bottom 3 of the device 1 so as the wheels 225 and the handle 75 are located on the same side of the refrigerator 1.

A power cord 150 (FIG. 11) may be attached to the foldable refrigerator 1. The power cord 150 may be attached to an electrical device (not shown) located within an inner wall of the device 1 which may power the device 1. Alternatively, or in addition to the electrical device, a battery (not shown) may be provided to power to device 1 giving the user the option of selecting alternating or direct current. In an embodiment, the battery may be a rechargeable battery. Further, the power cord 150 may be retractable and may be stored within an interior compartment opening 151 when not in use. Preferably, the interior compartment opening 151 is located on the back 5 of the device 1 and is deep so as to allow the power cord 150 to be stored in a flush manner with the back 5 of the device 1.

As stated above, within the interior 8 of the device 1 (when the device 1 is in the functional First Position A) may be a plurality of adjustable shelves 200 (FIG. 1). The plurality of adjustable shelves 200 may divide the interior 8 of the device 1 into multiple compartments; therein allowing the interior 8 of the device 1 to have at least two different temperature settings if desired. For example, the interior 8 of the device 1 may have a first section which may remain around forty degrees Fahrenheit for drinks and most other food items and a second section which may remain around zero degrees Fahrenheit to act as a freezer section to store, for example, ice cream. In an embodiment, the plurality of shelves 200 may be made of an insulating material such as a strong insulating glass. In an embodiment, the shelves 200 may be removed from the interior 8 of the device 1 so as to allow the entire interior 8 to remain a consistent temperature.

In an embodiment, the insulating material may be fire retardant. Further, the exterior of the device 1 is preferably light colored so as to reduce heat absorption. A compressor (not shown) may be located on the exterior surface 8 of the device 1. The compressor may be attached to the electrical device and may pull air into the device 1 wherein the air is cooled.

Figure 6:
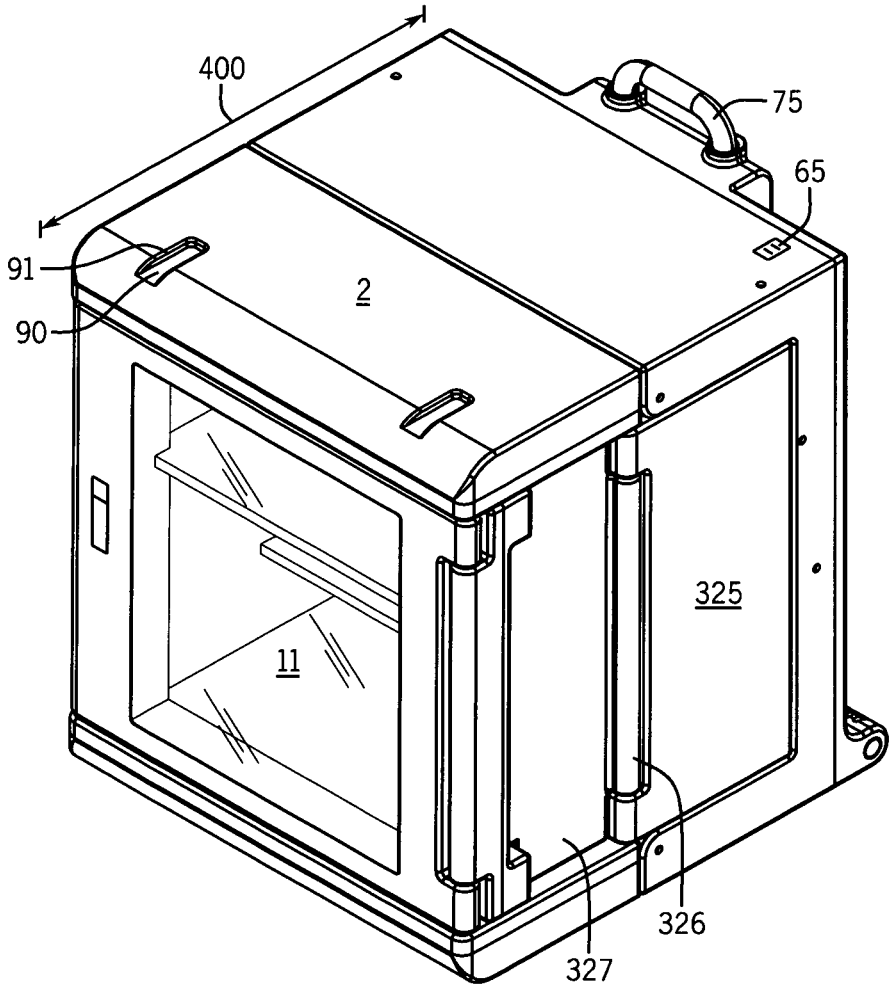
FIG. 6 illustrates a top perspective view of the First Embodiment of the foldable refrigerator in the functional First Position A.

Referring now to FIG. 6, in an embodiment, the foldable refrigerator 1 may have an outlet 65 for a microwave and/or toaster oven or the like. The outlet 65 may be located on the top 2 of the device 1 and may allow the device 1 to be used as a secondary power receptacle, much like a standard electrical power strip. The outlet 65 would therefore allow the refrigerator to be used in association with other small appliances or electrical devices by increasing the number of electrical devices that may be connected to a single electrical wall outlet.

Figure 4:
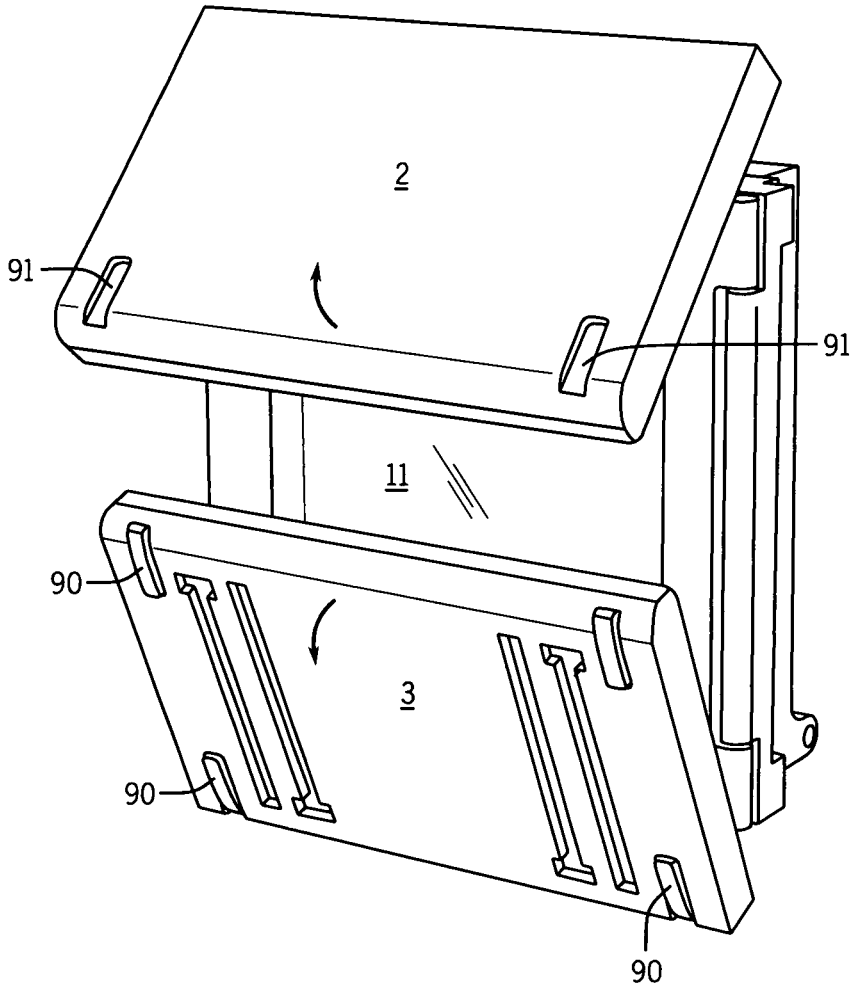
FIG. 4 illustrates a front perspective view of the First Embodiment of the foldable refrigerator wherein the foldable refrigerator is in the process of moving between the functional First Position A and the collapsed Second Position B.
Figure 5:
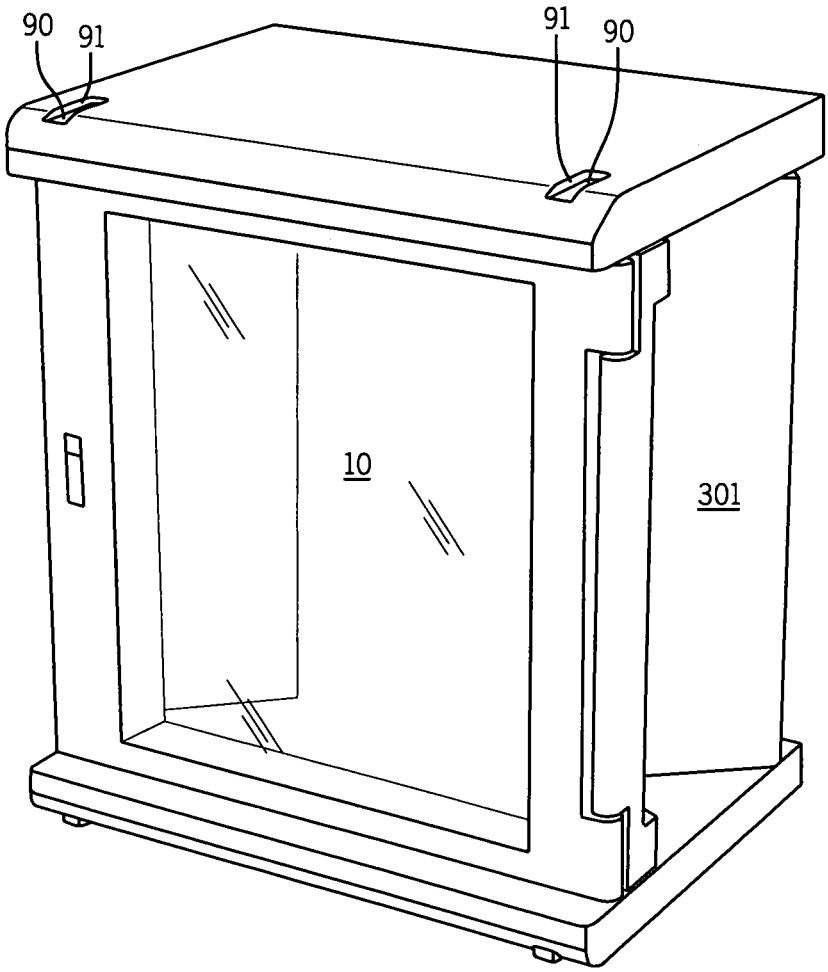
FIG. 5 illustrates a front perspective view of the First Embodiment of the foldable refrigerator almost in the functional First Position A.
Figure 15:
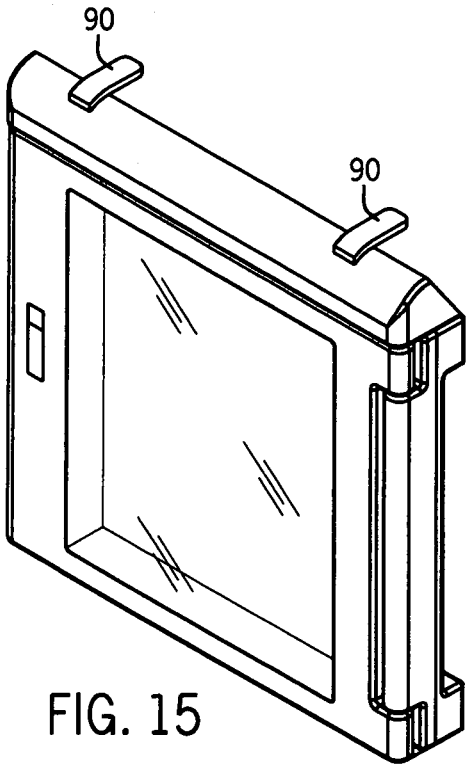
FIG. 15 illustrates the front door of the refrigerator.

Referring now to FIGS. 4 and 15, in an embodiment, the foldable refrigerator 1 may have a device locking mechanism 90 (FIG. 15). The device locking mechanism 90 may be located at various locations on the device 1. FIG. 4 illustrates four device locking mechanism 90 on the bottom 3 of the device 1. The device locking mechanism 90 may also be used as a floor protector to prevent scratching of the floor. The device locking mechanisms 90 may be notches which lock into openings 91 of the device 1. FIG. 4 illustrates two openings on the top 2 of the device 1. When a user wishes to use the device 1 in the functional First Position A, the user unfolds the top 2 and the bottom 3 and locks the device locking mechanism 90 into the openings 91. Preferably, the openings 91 are slightly greater in size than the device locking mechanisms 90 so that the device locking mechanisms 90 fit snugly within the openings 91 and are secured there by friction. FIG. 5 illustrates the device locking mechanisms 90 properly secured within the openings 91 of the device 1.

In an embodiment, for the bottom 3 of the device 1 only, device locking mechanism 90 may extend from the bottom surface to the top surface of the bottom 3. As a result, the top surface of the bottom 3 of the device 1 may allow the device locking mechanism 90 to lock into openings 91 on the bottom 24 of the door 10 (the openings 91 on the bottom 24 of the door 10 are not visible) and the device locking mechanism 90 may also extend to the bottom surface of the bottom 3 of the device 1 and may provide a soft surface for the refrigerator 1 to rest on so as to not scratch the floor.

Figure 2:
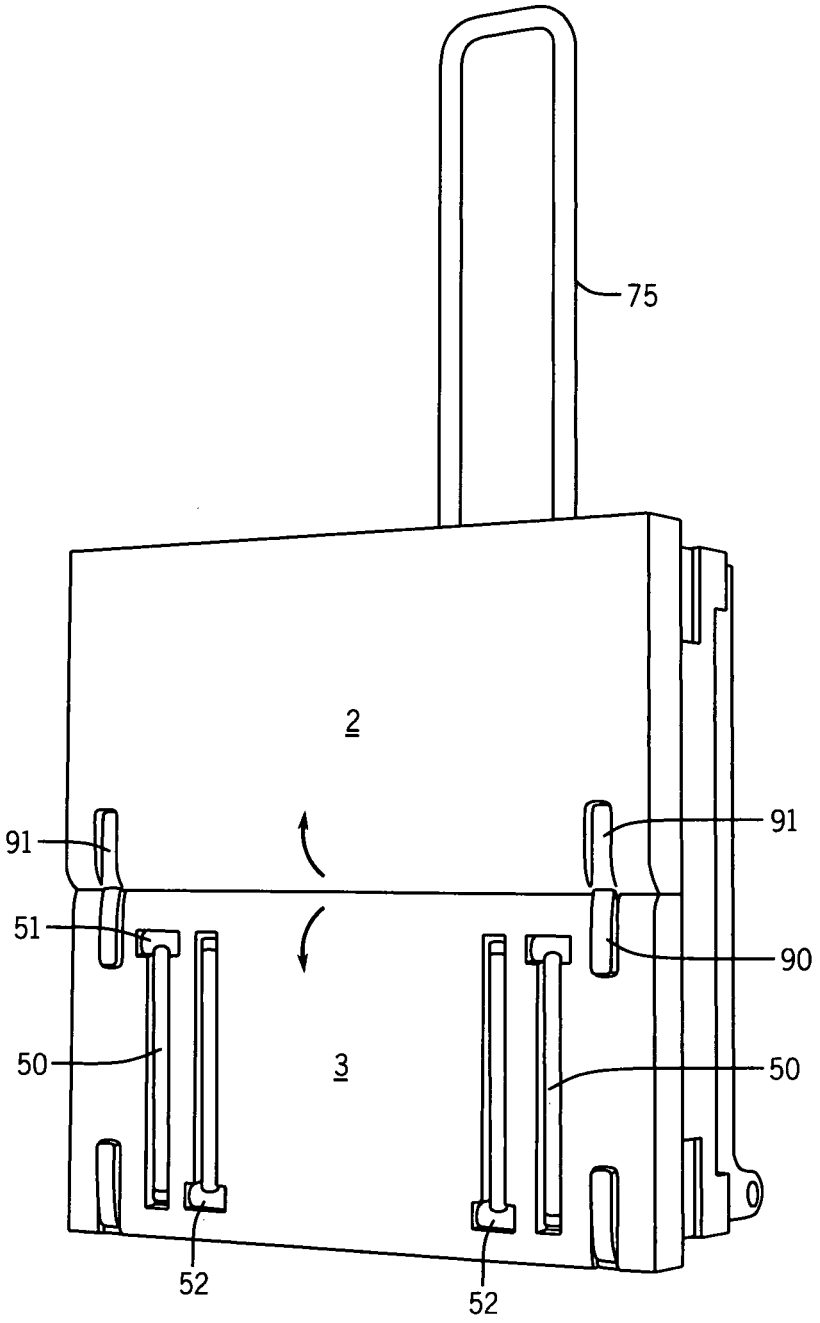
FIG. 2 illustrates a front perspective view of the First Embodiment of the foldable refrigerator in the collapsed Second Position B.

The foldable refrigerator may be folded in two different ways. FIGS. 1-5 illustrate the First Embodiment and FIGS. 6-14 illustrate the Second Embodiment. Referring first to the First Embodiment of FIGS. 1-5, the foldable refrigerator 1 may back and forth between the functional First Position A (FIG. 1) to the collapsed Second Position B (FIG. 2).

Referring again to FIG. 1, the second side 7 of the refrigerator 1 may have a first panel section 300 and a second panel section 301. In the functional First Position A, the first panel section 300 and second panel section 301 may be generally parallel to each other and generally parallel to the sides of the device 1. A generally cylindrical hinge 302 may connect the first panel section 300 to the second panel section 301 and may allow the first panel section 300 to rotate with respect to the second panel section 301. The first side 6 of the device 1 may also have a first panel section and a second panel section similar to the second side of the device 1.

In an embodiment, a gasket 310 may surround the perimeter of the first panel section 300 and the second panel section 301 (as well as the panels on the first side of the device 1). Preferably, the gasket 310 is made from rubber. The gasket 310 may create a liquid tight seal between the interior 8 of the refrigerator 1 and the outside. Further, the gasket 310 may prevent the loss of cool air from within the interior 8 of the refrigerator 1, therein saving energy.

To convert the First Embodiment of the foldable refrigerator 1 from the collapsed Second Position B to the functional First Position A, a user first pulls the top 2 (FIG. 2) and the bottom 3 outward. More specifically, in the collapsed Second Position B, the top 2 and the bottom 3 of the device 1 are generally parallel to each other and to the back 5 of the device 1. Further top 2 and the bottom 3 of the device 1 in the collapsed Second Position B remain largely flush to each other and occupy the same geographic plane. In addition, when the device 1 is in the collapsed Second Position B, the top 2 and the bottom 3 of the device 1 protect the window 11 of the door 10 of the device 1 (as is illustrated in FIG. 4). In converting the device 1, the top 2 and the bottom 3 both are rotated via a hinge 555 (FIG. 7) approximately ninety degrees so that the top 2 and the bottom 3 both are perpendicular to the back 5 of the device 1. FIG. 4 illustrates the top 2 and the bottom 3 rotated approximately forty-five degrees with respect to the back 5 of the device 1.

Once the top 2 and the bottom 3 are rotated to approximately ninety degrees with respect to the back 5 of the device 1, the sides 6, 7 of the device 1 may be rotated outward to form the functional refrigerator 1. To rotate the sides 6, 7 of the device 1 outward, the first panel section 300 is rotated with respect to the second panel section 301 so that both the first panel section 300 and the second panel section 301 move from a parallel position with respect to the back 5 of the device 1 to a generally perpendicular position with respect to the back 5 of the device 1.

Once the device 1 is in the functional First Position A, the removable shelves 200 may be inserted into the interior 8 of the refrigerator 1. The removable shelves 200 may be adjusted via pegs and holes (not shown) so that a user may select the size of the area above and below each shelf 200. To convert the refrigerator 1 back to the collapsed Second Position B, the removable shelves 200 are removed first and then the reverse procedure is done. In the collapsed Second Position B, the refrigerator 1 may be easily stored and/or transported.

Referring now to FIGS. 6-14, the Second Embodiment of the refrigerator 1 is illustrated. FIG. 6 illustrates the device 1 in the functional First Position A. In this Second Embodiment, the back 5 of the device 1 and a portion of the top 2 of the device 1 and the bottom 3 of the device 1 may be connected. More specifically, in the Second Embodiment, the device 1 may have a generally u-shaped back 5. In this embodiment, the top 2 and the bottom 3 are divided in half and only half of the top 2 and half of the bottom 3 rotate with respect to the back 5 of the device 1. Further, in this Second Embodiment, a second side 7 has a first portion 325 and a second portion 327 which rotate with respect to each other at a hinge 326 (the same is repeated on the first side 6 of the device 1).

Figure 7:
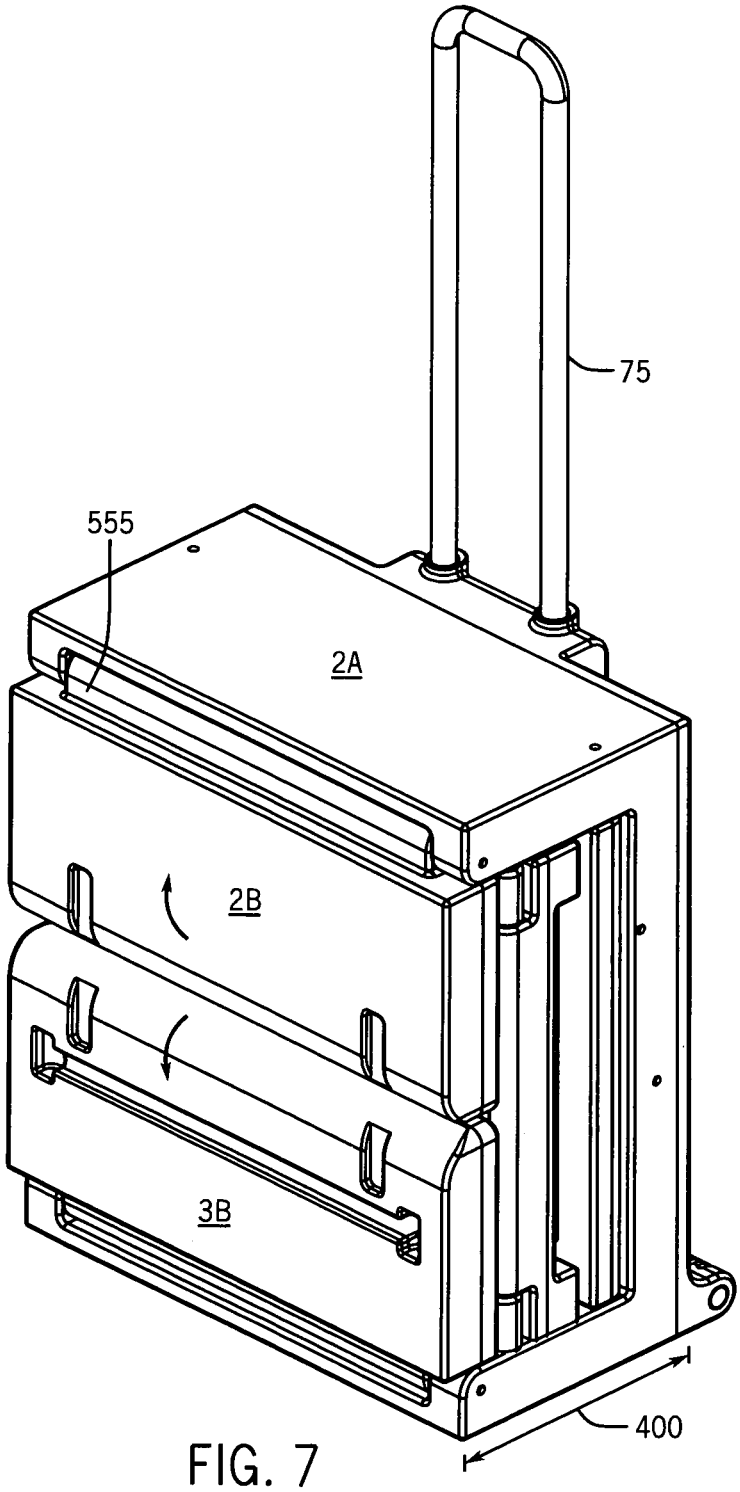
FIG. 7 illustrates a front perspective view of the Second Embodiment of the foldable refrigerator in the collapsed Second Position B.
Figure 8:
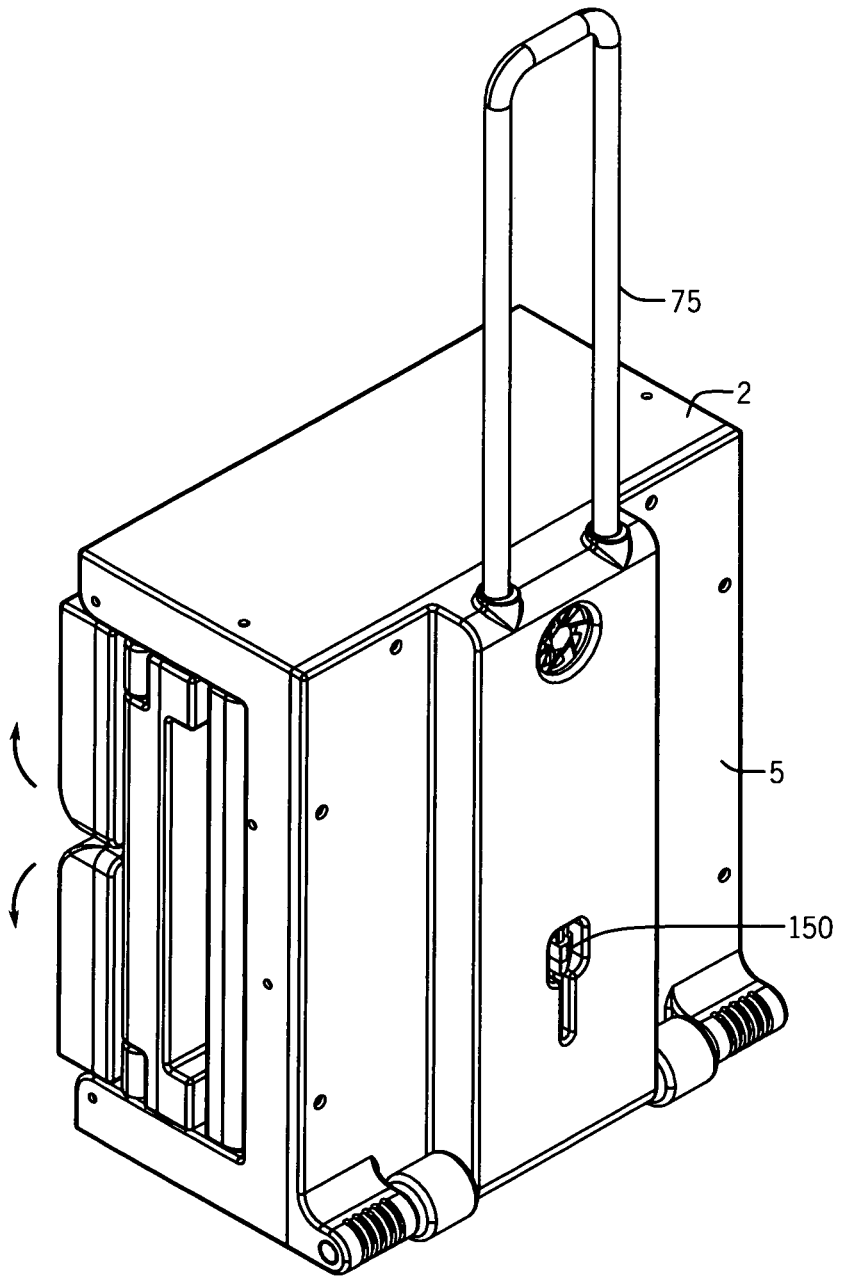
FIG. 8 illustrates a back perspective view of the Second Embodiment of the foldable refrigerator in the collapsed Second Position B.
Figure 9:
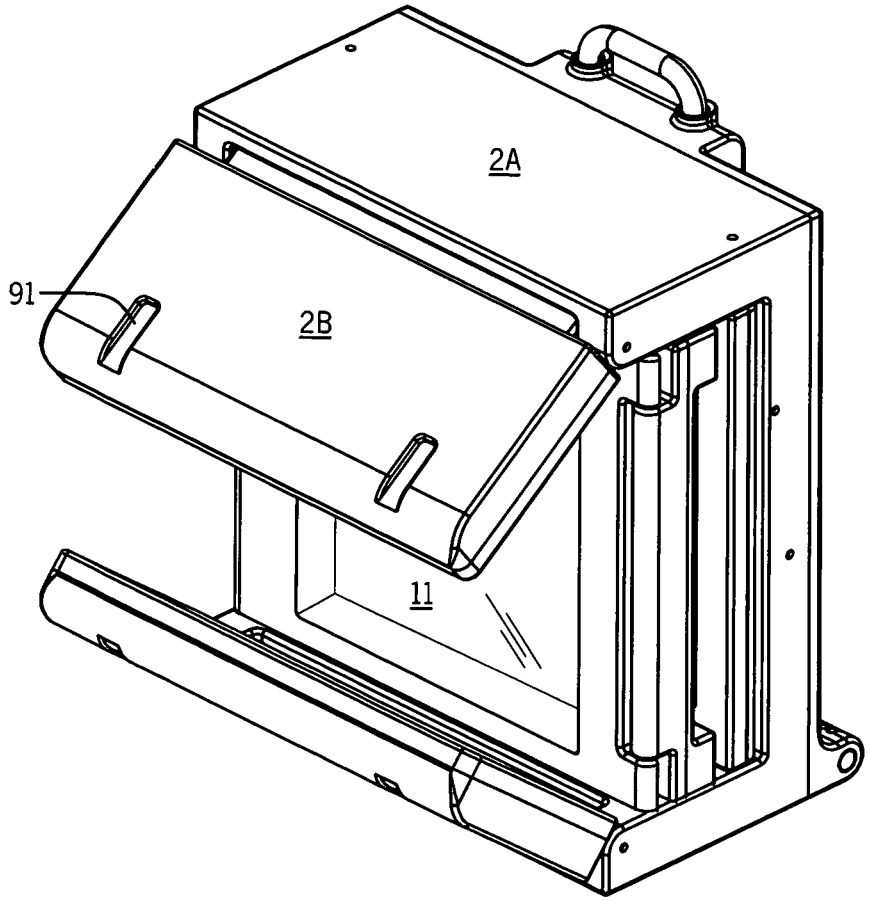
FIG. 9 illustrates a front perspective view of the Second Embodiment of the foldable refrigerator wherein the foldable refrigerator is between the functional First Position A and the collapsed Second Position B.
Figure 10:
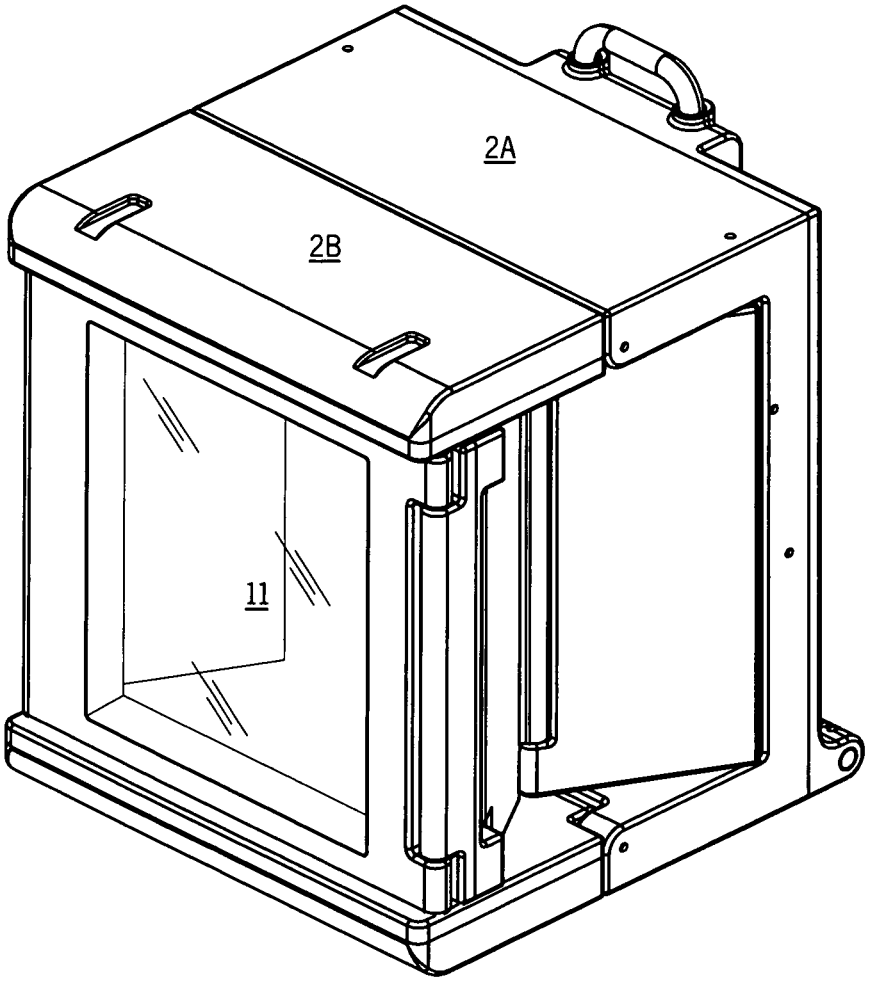
FIG. 10 illustrates a front perspective view of the Second Embodiment of the foldable refrigerator wherein the foldable refrigerator is almost in the functional First Position A.

Referring now to FIG. 7, in the collapsed Second Position B, the refrigerator 1 is in a more condensed state which is easier to transport and store. As stated above, in the Second Embodiment, the top 2 of the refrigerator 1 may be divided into a first portion 2A and a second portion 2B. The bottom 3 of the refrigerator 1 may also be divided into a first portion 3A and a second portion 3B. In the collapsed Second Position B, the depth 400 of the device 1 is less than the depth 400 of the device 1 when the refrigerator 1 is in the functional First Position A (FIG. 6).

Figure 11:
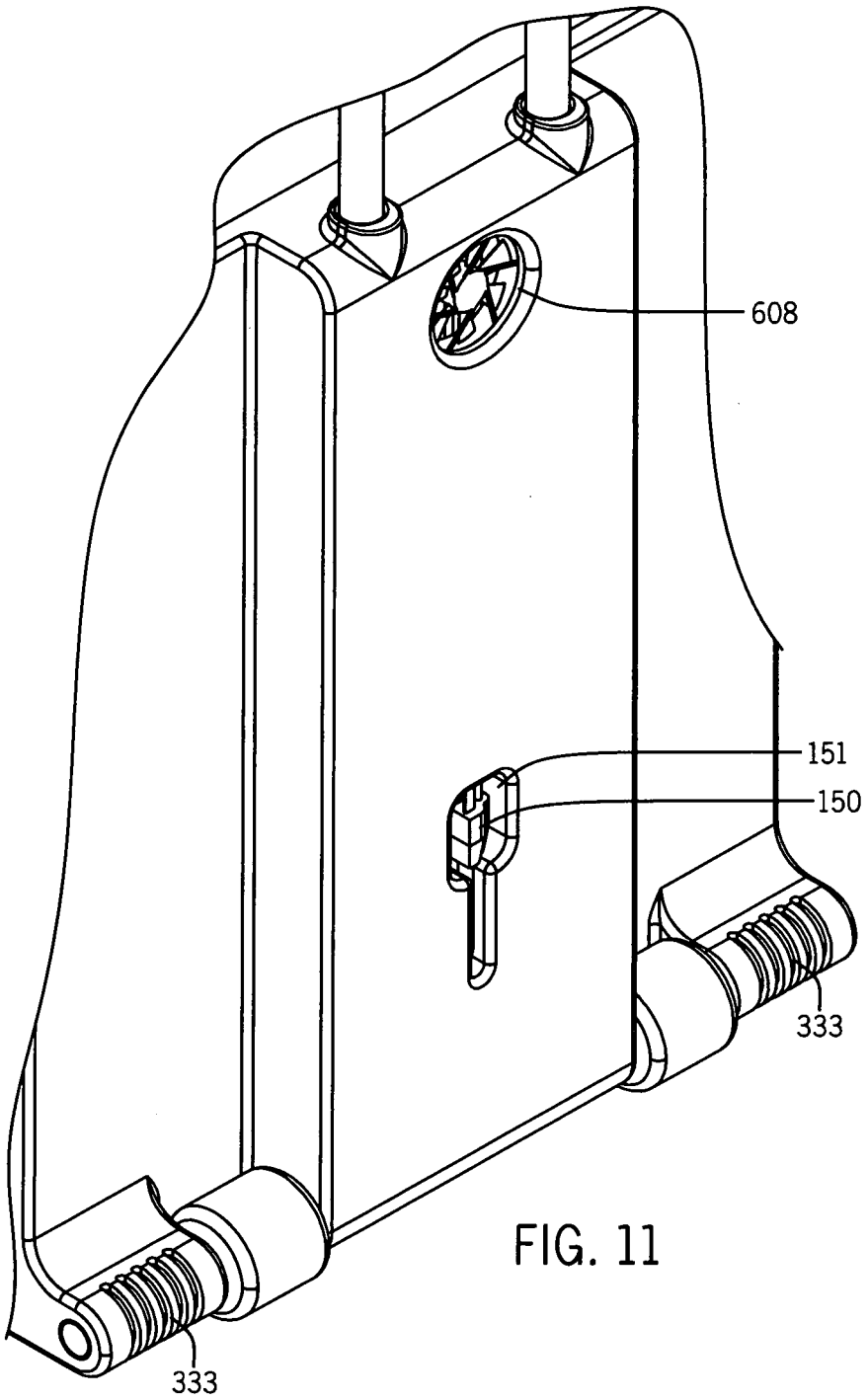
FIG. 11 illustrates a close up view of the back of the foldable refrigerator.

Referring now to FIG. 11, in an embodiment, the refrigerator 1 may have a fan 608. The fan 608 may provide air flow to the interior of the device 1 so as to cool the motor (not shown). In an embodiment, the motor and electrical equipment is located within a back compartment 714 (FIG. 3) of the device 1.

Referring now to FIGS. 12A and 12B, in an embodiment, the shelves 200 may be permanently secured to the device 1. In this embodiment, the shelves 200 are not removed from the device 1 when the device 1 is in the collapsed Second Position B, but instead the shelves 200 are merely rotated at a hinge 261. FIG. 12B illustrates the shelves 200 in the functional upward position. To collapse the device, the shelves 200 are rotated downward (FIG. 12A) prior to collapsing the device 1. In addition, the device 1 may simply be used in the functional First Position A (FIG. 12A) while keeping the shelves 200 rotated down (and parallel to the back 5). This allows a user to insert a larger item into the interior 8 of the refrigerator 1. In an embodiment, the shelves 200 may be of different sizes. As a result, items of various sizes may be more easily stored within the interior 8 of the device 1.

Figure 18:
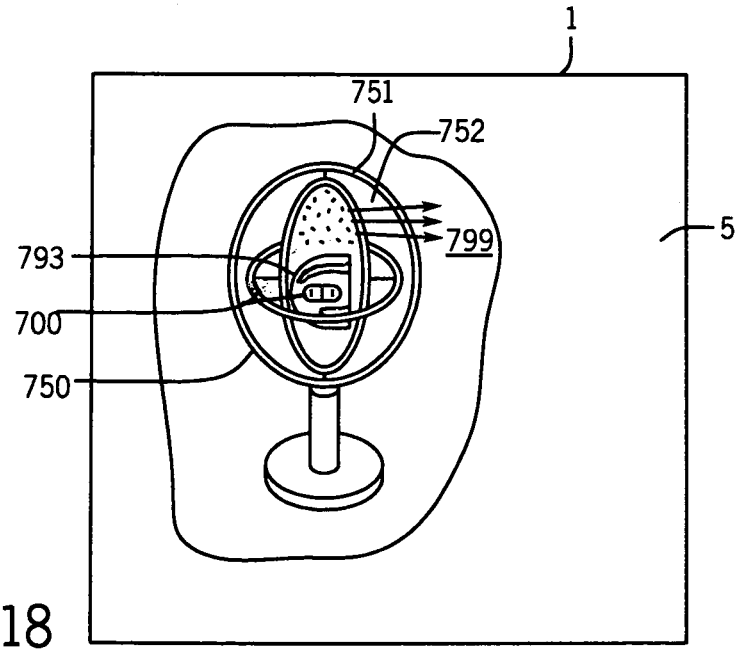
FIG. 18 illustrates a cut away view of an embodiment of the refrigerator wherein a gyroscope keeps the compressor of the refrigerator in a stable upright orientation.
Figure 16:
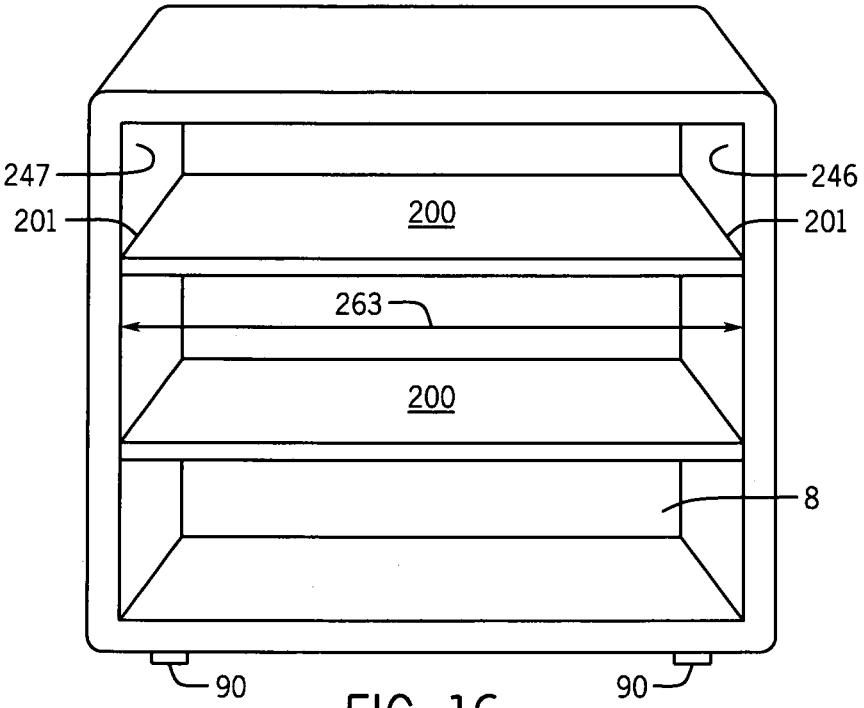
FIG. 16 illustrates a perspective view of the interior of the refrigerator wherein the shelves are secured in the upright functional position and the door is removed.
Figure 17:
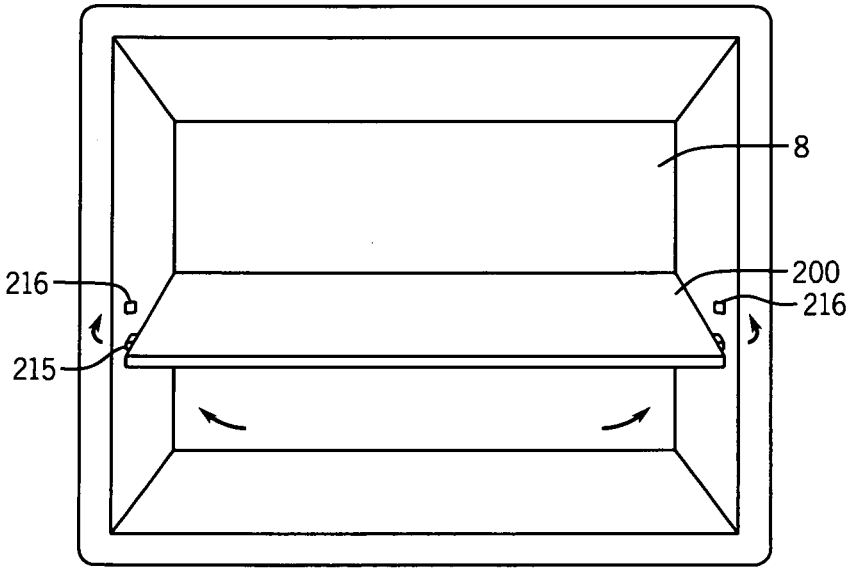
FIG. 17 illustrates the notches of the shelves of the refrigerator and the shelves being rotated upward to locking into the indentation of the sides of the refrigerator.

Referring now to FIG. 18, in an embodiment, notches 215 (FIG. 12B) may be located on the sides of the shelves 200 of the refrigerator 1. Further, in an embodiment, an indentation 216 (FIG. 17) may be located on each of the interior surfaces of the first side 6 and the second side 7 of the refrigerator 1. The indentation 216 may be slightly larger than the notches 215 of the shelves 200 such that the notches 215 of the shelves 200 may be temporarily securely locked within the indentation 216 by, for example, friction. A user may rotate the shelves 200 upward at the hinge 261 of the refrigerator 1 (if the refrigerator 1 has the hinge 261 as in FIGS. 12A and 12B) or the user may simply insert the notches 215 of the shelves 200 into the indentations 216 of the sides 6, 7 if the refrigerator 1 lacks the rotating hinge 261 of FIGS. 12A and 12B. In an embodiment, the notches 215 of the shelves 200 snap into the indentation 216 of the first side 6 and the second side 7 of the refrigerator 1 and allow the shelves 200 to remain substantially parallel to the ground when the refrigerator 1 is in the functional orientation.

In an embodiment, when the shelves 200 are inserted into the interior 8 of the refrigerator 1 or wherein the shelves 200 rotated into the upward useful position (FIGS. 12A and 12B), the sides 201 of the shelves 200 may contact the interior side surfaces 246, 247 of the sides 6, 7 of the refrigerator 1. More specifically, the length 263 of the shelves 200 may be substantially similar to the distance 263 between the interior first side 6 and the interior second side 7 of the refrigerator 1 when the refrigerator 1 is in the functional First Position A. As a result, the pressure from the sides 201 of the shelves 200 helps to keep the sides 6, 7 straight and locked into the functional First Position A orientation.

Referring now to FIGS. 12A and 12B, in an embodiment, a protective pad 675 may be located in the underside of the top 2 and the bottom 3 of the device 1. The protective pad 675 may provide a buffer between the top 2 of the device 1 and the glass window 11; and between the bottom 3 of the device 1 and the glass window 11 when the device 1 is in the collapsed Second Position B. As a result, the window 11 does not directly contact the top 2 or the bottom 3 of the device 1 when the device 1 is folded; therein reducing possible breakage of the glass window 11.

In an embodiment, the sides 6, 7 may lock to the bottom 3 and the top 2 of the refrigerator 1 by a pressure lock 831 (FIG. 5). The pressure lock 831 may be an indentation which secures the sides 6, 7 of the refrigerator 1 to the upper surface of the bottom 3 of the refrigerator 1 and to the lower surface of the top 2 of the refrigerator 1. More specifically, the when the refrigerator 1 is in the functional First Position A, a slight pressure created inside the interior 8 of the refrigerator 1 may force the sides 6, 7 into a generally perpendicular orientation with respect the top 2 and the bottom 3 of the refrigerator. 1 Finally, in an alternative embodiment, the upper surface of the bottom 3 of the device 1 as well as the lower top 2 surface of the device 1 may have a magnet 832 (Also illustrated in FIG. 5). A magnet 833 having an opposing polarity may be located on the bottom and the top of the sides 6, 7 of the refrigerator 1. When the sides 6, 7 are moved into a generally perpendicular orientation with respect to the bottom 3 and top 2 of the device 1 (in the functional First Position A), the magnets 832, 833 may temporarily secure the sides 6, 7 in the proper functional orientation for the First Position A.

Referring now to FIG. 18, as with a standard refrigerator, the present refrigerator 1 may have a compressor 700 (FIG. 18). In an embodiment, the compressor 700 of the present refrigerator 1 may be generally spherical in shape. The compressor 700 of the present device 1 may compress ammonia gas. The compressed ammonia gas may heat up as it is pressurized. Coils 793 (the dark outermost ring in interior loops of FIG. 18) in the refrigerator 1 let the hot ammonia gas dissipate its heat. The ammonia gas then condenses into ammonia liquid at a high pressure. The high-pressure ammonia liquid then flows through an expansion valve (small hole). On one side of the valve is a high pressure ammonia liquid and on the other side of the valve is the low-pressure area. The liquid ammonia immediately boils and vaporizes, its temperature dropping to approximately −27 F therein making the refrigerator 1 cold. The ammonia gas is then sucked up by the compressor 700 and the process cycle repeats. In an embodiment, the coils 793 are also located within the gyroscope 750. As a result, the only the cold air 799 exits the gyroscope 750 as the entire cooling system is located within the interior 752 of the gyroscope 750. In an embodiment, the compressor 700 may be electrically connected to a power source, such as a battery located within the compressor 700 or the compressor 700 may be connected to an AC power source.

In an embodiment, the refrigerator 1 may have a gyroscope 750. The gyroscope 750 may have an exterior surface 751 and a generally hollow interior 752. Located within the interior 752 of the gyroscope 750 may be the compressor 700 of the refrigerator. The gyroscope 750 may allow the compressor 700 to remain in a generally upright orientation with respect to the ground. More specifically, the gyroscope 750 may allow the compression system 700 to function properly without, for example, the ammonia gas flowing improperly. Further, the gyroscope 750 may allow the compression system 700 to face any direction.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A refrigerator capable of being folded comprising:

a housing having a top, a bottom, a first side, a second side, a front, a back and a generally hollow interior when the refrigerator is in a functional orientation;

wherein the first side and the second side of the housing each have a first panel and a second panel and wherein a hinge separates the first panel and the second panel of each side of the housing and wherein the first panel and the second panel of each side of the housing can rotate with respect to each other;

a hinge connecting the top of the housing to the back of the housing wherein the top of the housing moves from a generally parallel orientation with respect to the back of the housing to a generally perpendicular orientation with respect to the back of the housing;

a hinge connecting the bottom of the housing to the back of the housing wherein the bottom of the housing moves from a generally parallel orientation with respect to the back of the housing to a generally perpendicular orientation with respect to the back of the housing; and wherein the refrigerator is an a functional orientation having the generally hollow interior when the top of the housing, the bottom of the housing, the first side of the housing and the second side of the housing are in a generally perpendicular orientation with respect to the back of the housing.

2. The foldable refrigerator of claim 1 further comprising:

a transparent surface located on the front of the housing wherein the transparent surface is plastic or glass and wherein the transparent surface allows a user to see into the interior of the housing when the refrigerator is in the functional orientation.

3. The foldable refrigerator of claim 2 wherein the top of the housing has an interior facing surface and wherein the bottom of the housing has an interior facing housing; and a padded surface located on the interior facing surface of the top or the interior facing surface of the bottom of the housing wherein the padded surface prevents damage the transparent layer of the front of the housing.

4. The foldable refrigerator of claim 1 further comprising:

an extendable telescoping handle secured to the back of the housing wherein the extendable telescoping handle moves from a first position to a second position.

5. The foldable refrigerator of claim 1 further comprising:

a plurality of wheels secured to the bottom of the housing wherein the plurality of wheels allows the refrigerator to be pushed or pulled with minimal friction.

6. The foldable refrigerator of claim 1 further comprising: a removable shelf temporarily secured to the generally hollow interior of the refrigerator wherein the removable shelf has a top, a bottom, a front, a back, a first side and a second side; and wherein the first side and the second side of the shelf have notches which correspondingly lock into indentations located on an interior surface of the first side and the second side of the housing and wherein the notches are temporarily secured within the indentations of the interior surface of the first side and the second side of the refrigerator by friction.

7. The foldable refrigerator of claim 1 further comprising: a permanently secured shelf located within the interior of the housing wherein the permanently secured shelf has a top, a bottom, a front, a back, a first side and a second side and wherein the back of the permanently secured shelf is permanently secured to a hinge which is then permanently secured to the back of the refrigerator wherein the hinge allows the shelf to move from a first position generally parallel to the back of the refrigerator to a second position wherein the permanently secured shelf is in a generally perpendicular orientation with respect to the back of the refrigerator; and a securing means to temporarily secure the front of the permanently secured shelf to the first side and the second side of the refrigerator.

8. The foldable refrigerator of claim 1 further comprising: a plurality of telescoping legs located on the bottom of the housing wherein the plurality of telescoping legs allows the bottom of the refrigerator to be elevated from a first position to a second position.

9. The foldable refrigerator of claim 1 further comprising: a gyroscope having an interior located within an interior wall of the housing; a compressor located within the interior of the gyroscope wherein the compressor converts ammonia gas into liquid ammonia wherein the liquid ammonia is then vaporized causing a drop in temperature which escapes the interior of the gyroscope and cools the interior of the housing of the refrigerator.

10. The foldable refrigerator of claim 1 further comprising: a first magnet located on an upper surface of the bottom of the housing and a second magnet having an opposing polarity located on the first side or the second side of the housing wherein the first magnet of the upper surface of the bottom of the housing temporarily secures the first side or the second side of the housing into a generally perpendicular orientation with respect to the bottom of the housing.

11. The foldable refrigerator of claim 1 further comprising: a locking mechanism on the front of the housing wherein the locking mechanism locks the front of the housing to the a side of the housing or the bottom of the housing.

12. The foldable refrigerator of claim 1 further comprising: an electrical outlet located on the top, the bottom, the front, the back, the first side or the second side of the housing wherein the electrical outlet allows a second electrical object to plug into a power source located within the housing of the refrigerator and which powers the refrigerator.

13. The foldable refrigerator of claim 7 further comprising: a hinge securing each of the plurality of telescoping legs to the bottom of the housing wherein the hinge allows the telescoping legs to move from a generally parallel orientation with respect to the bottom of the housing to a generally perpendicular orientation with respect to the bottom of the housings wherein the telescoping legs can then telescope and expand outward.

14. The foldable refrigerator of claim 1 further comprising: a fan secured partially within a wall of the housing wherein the fan cools a compressor of the refrigerator.

* * * * *